US005982329A

United States Patent [19]

Pittman et al.

[11] Patent Number: 5,982,329

[45] Date of Patent: Nov. 9, 1999

[54] SINGLE CHANNEL TRANSCEIVER WITH POLARIZATION DIVERSITY

[75] Inventors: William C. Pittman; Ralph H. Halladay, both of Huntsville, Ala.

[73] Assignee: The United States of America as represented by the Secretary of the Army, Washington, D.C.

[21] Appl. No.: 09/149,251

[22] Filed: Sep. 8, 1998

[51] Int. Cl.[6] ..... H01Q 1/38

[52] U.S. Cl. ..... 343/700 MS; 343/754

[58] Field of Search ..... 343/700 MS, 769, 343/846, 829, 754; 342/175; H01Q 1/38

[56] References Cited

U.S. PATENT DOCUMENTS

| | | | |
|---|---|---|---|
| 3,772,689 | 11/1973 | Root, Jr. | 343/5 SA |
| 4,410,891 | 10/1983 | Schaubert et al. | 343/700 |
| 4,472,717 | 9/1984 | Eaves et al. | 343/5 SA |
| 4,728,960 | 3/1988 | Lo | 343/700 MS |
| 5,485,164 | 1/1996 | Compton et al. | 343/700 MS |
| 5,493,303 | 2/1996 | Kolak | 342/153 |
| 5,493,305 | 2/1996 | Wooldridge et al. | 342/368 |
| 5,512,901 | 4/1996 | Chen et al. | 342/175 |

*Primary Examiner*—Don Wong
*Assistant Examiner*—Shih-Chao Chen
*Attorney, Agent, or Firm*—Arthur H. Tischer; Hay Kyung Chang

[57] ABSTRACT

The single channel transceiver with polarization diversity is a target detection and tracking system that results from combining the well-established technology of single channel transceiver with that of microstrip polarization-diverse antenna. The single channel transceiver with polarization diversity transmits a pair of pulses of a pre-selected polarization sense toward a target object and receives two scattered pulses of orthogonal polarizations in rapid sequence. Thereupon, a second pair of pulses, this time of opposite polarization, is transmitted and, again, two scattered pulses of orthogonal polarizations from this second pair of transmitted pulses are received in rapid sequence. Thus, the single channel transceiver with polarization diversity has the capability to obtain the complete scattering matrix of a target by use of four transmitted pulses. The received scattered pulses are further processed by the transceiver to derive the polarization signature that is indicative of the nature of the object from which they scattered in reflection and thereafter used to identify the target among clutter or background.

10 Claims, 5 Drawing Sheets

SINGLE CHANNEL TRANSCEIVER WITH POLARIZATION DIVERSITY

DEDICATORY CLAUSE

The invention described herein may be manufactured, used and licensed by or for the Government for governmental purposes without the payment to us of any royalties thereon.

BACKGROUND OF THE INVENTION

Within the last fifty years, efforts have been expended by the Navy, Army and the Air Force to develop a system for detection and discrimination of targets among clutter (be it on the surface of the sea or in land) as well as a means for stabilizing the aimpoint of tracking radars. A typical system comprises a transmitter and a two-channel receiver where the transmitter emits radiation of a selected polarization and the receiver receives two orthogonal polarization simultaneously on a polarization-insensitive antenna.

A fully polarimetric radar system requires a transmitter that is capable of radiating both polarization senses (horizontal and vertical or, equivalently, right circular and left circular) and a receiver that is capable of receiving and processing both polarization senses of the reflected scattered energy simultaneously. A typical such system may transmit alternate radiations of vertical and horizontal polarizations, for example, by means of waveguide ferrite switches. On receive, orthomode transducers derive separate horizontal and vertical polarization senses from a common polarization-insensitive antenna. The orthogonal signals are then processed in a two-channel receiver. Such fully polarimetric radars generate an enormous amount of data which is desirable but the necessary signal processing in real-time requires ultra-complex processors.

Many applications of polarimetric signal processing in weapon systems can tolerate only limited hardware and signal processing complexity. Therefore, as a compromise, polarization-sensitive architectures that do not yield the full complement of scattering matrix are often used. These systems generally transmit only one sense of polarization with the two-channel receiver receiving and processing the co-polarized and cross-polarized back-scattered energy simultaneously. Consequently, the two channels must be phase and amplitude-tracked through the final detector, resulting in a complex and expensive radar receiver front-end for the missile seeker on which such a radar system may be mounted.

The volume and cost of smart munitions often further exclude the wide use of multi-channel receivers. However, the target data contained in both the cross and co-polarized return energy is still desirable for accurate target identification among the clutter. One solution could be using receivers which separate the orthogonal polarizations, then time-multiplexing these signals into a common receiver channel. But the orthomode transducers which are required in such a solution are generally built from hybrid waveguide structures or by the use of reflective antennas with diagonal grid polarizers—both bulky components.

SUMMARY OF THE INVENTION

Applicants' single channel transceiver with polarization diversity is a target detection and tracking system that is simple, small in size and fairly inexpensive. It is a result of combining the well-established technology of single channel transceiver with that of microstrip polarization-diverse antenna as taught by Daniel H. Schaubert et al in U.S. Pat. No. 4,410,891 (Oct. 18, 1983). The single channel transceiver with polarization diversity transmits a pair of pulses of a pre-selected polarization sense toward a target object and receives the scattering reflections of the two pulses of orthogonal polarizations in rapid sequence. Thereupon, a second pair of pulses, this time of opposite polarization, is transmitted and, again, the scattering reflections of this second pair of pulses of orthogonal polarizations are received in rapid sequence. Thus, the single channel transceiver with polarization diversity exhibits the capability to obtain the complete scattering matrix of a target by use of four pulses. The received energy is further processed by the transceiver to derive the polarization signature that is indicative of the nature of the object from which it scattered in reflection and thereafter used to identify the target among clutter or background.

DESCRIPTION OF THE PREFERRED EMBODIMENT

Since the single channel transceiver with polarization diversity is a result of combining the well-established technology of single channel transceiver with that of microstrip polarization-diverse antenna as taught in U.S. Pat. No. 4,410,891, it is beneficial at this point to review the traditional single channel transceiver whose structure is depicted in FIG. 1 as well as review the teachings of the Schaubert patent on polarization-diverse microstrip antenna.

Figure 1:
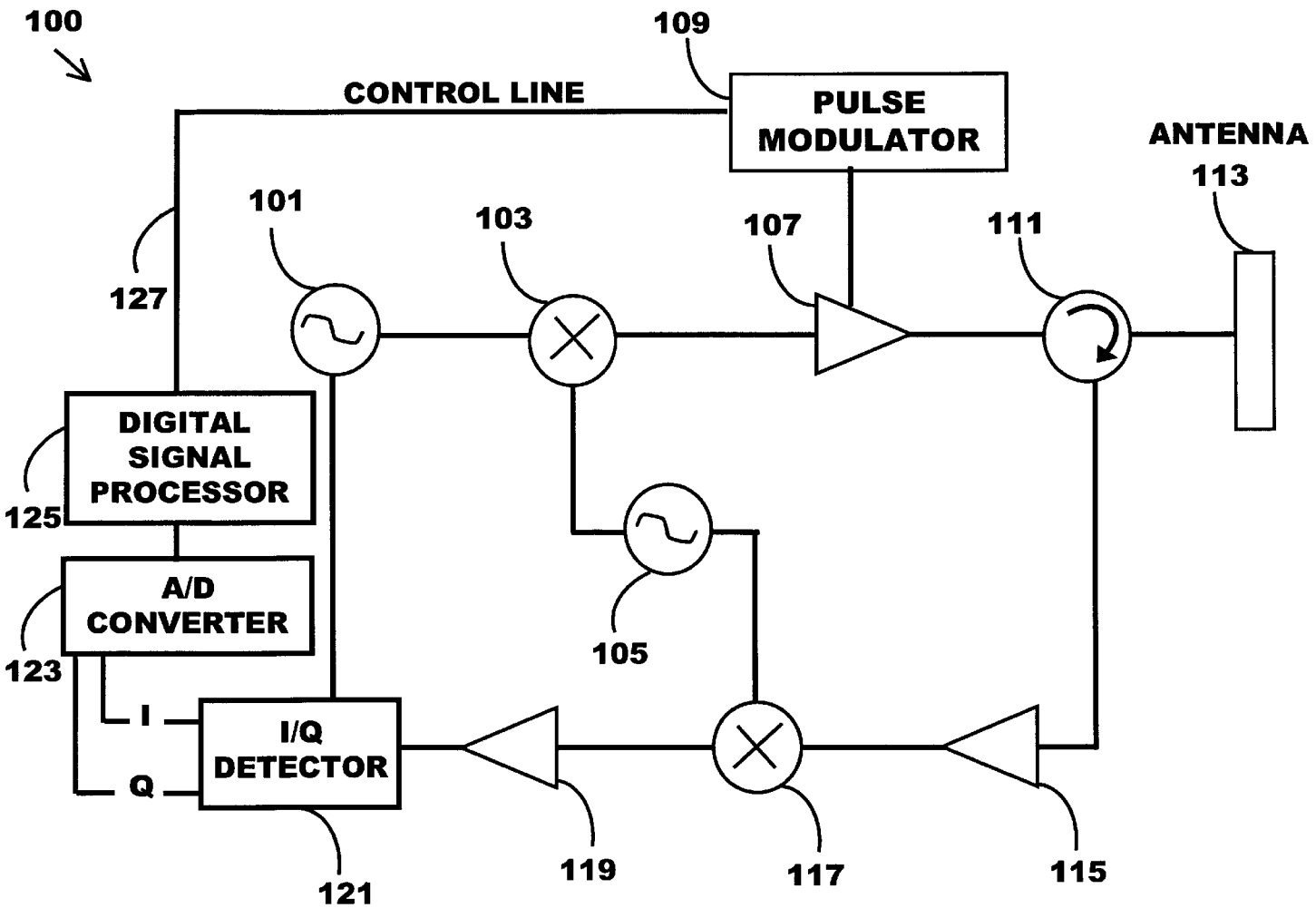
PRIOR ART FIG. 1
FIG. 1 shows a traditional single channel transceiver.

First, with reference to FIG. 1, wherein, as in the other figures, like numbers represent like parts, single channel transceiver 100 begins its operation when the output of coherent oscillator 101 is transmitted to up-converter 103, which is coupled to stable oscillator 105, to produce a radio frequency (RF) signal at a desired frequency. Power amplifier 107 amplifies and modulates the RF signal in response to input from pulse modulator 109. The resulting pulsed waveform is then routed by duplexer 111 to antenna 113 from which it is radiated outwardly toward, say, a potential target. The duplexer allows the high power pulsed waveform to pass to the antenna while isolating the receiving components (depicted in the lower part of FIG. 1) of the transceiver from the same waveform. On reception, the energy scattering from the surface of the potential target is collected by antenna 113 and routed by the duplexer to low noise amplifier 115 wherein the weak received signals are amplified. The output of the low noise amplifier is mixed in down-converter 117 with the input from stable oscillator 105 to lower the frequency of the received signals to an intermediate frequency (IF). The IF signals are then amplified in IF amplifier 119 and transmitted to in-phase and quadrature (I/Q) detector 121. The I/Q detector, in response to coherent oscillator 101 to which it is coupled, processes the amplified IF signals to derive therefrom baseband signal that is stripped of all modulation. The baseband signal is then input to analog-to-digital (A/D) converter 123 which produces the digital representation of the analog signal. The digital signal is input to digital signal processor 125 which, in response to programs resident therein, analyzes the scattering phases and amplitudes of co-polarized and cross-polarized return pulses. A target is detected based on the fact that scattering return pulses from a target (usually man-made object) have different polarization characteristics from those of natural clutter or background scenery. First control line 127 from the digital signal processor to the pulse modulator provides the means for controlling the pulse repetition frequency and waveforms of the pulse modulator.

Figure 2:
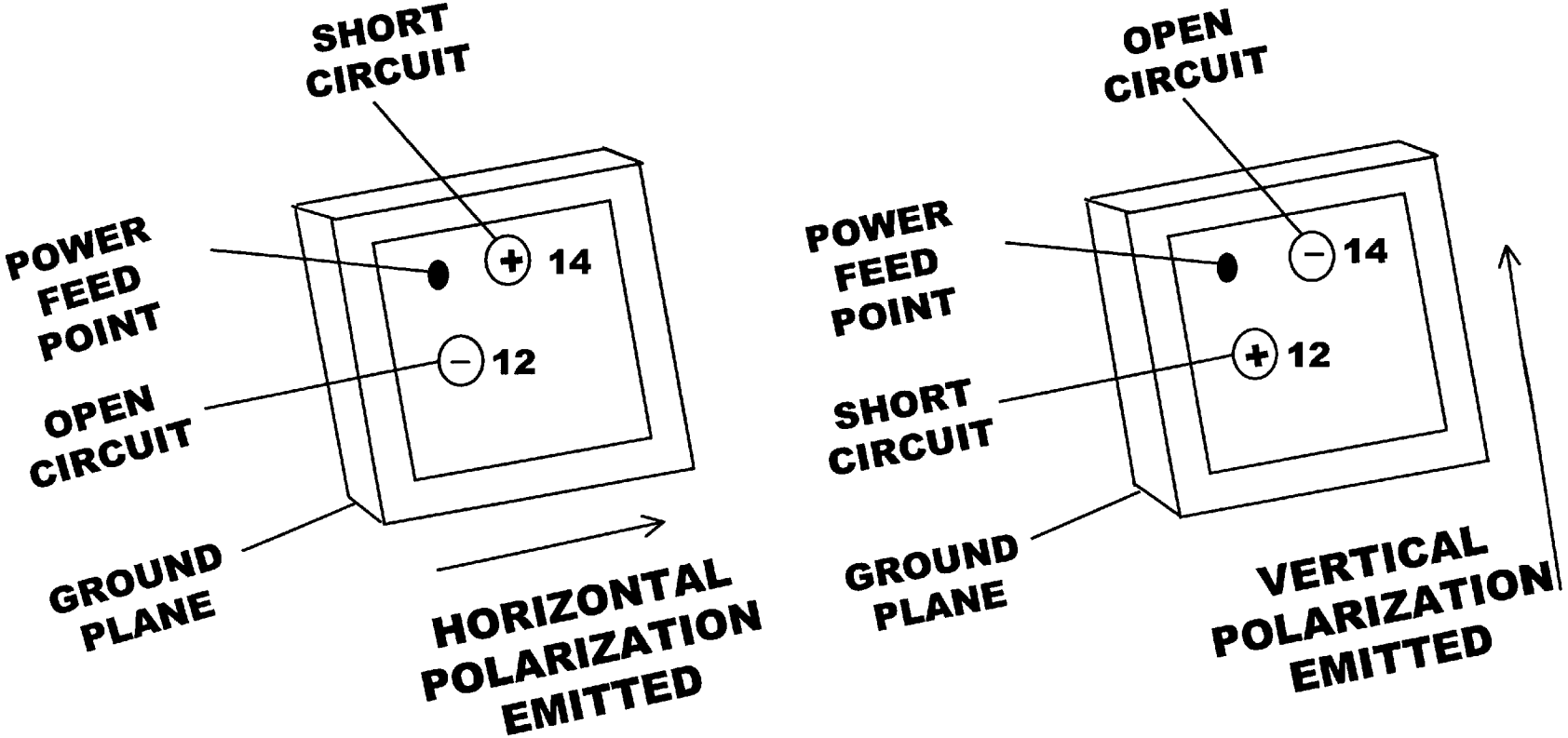
PRIOR ART FIG. 2
FIG. 2 illustrates an embodiment of the microstrip antenna in accordance with Schaubert teaching that emits or receives radiation linearly polarized in either vertical or horizontal direction.

Second, the structure and operation of the microstrip antenna with polarization diversity is explained in the Schaubert patent (U.S. Pat. No. 4,410,891) whose teachings are incorporated herein. In pertinent portions such as col. 2, lines 33 through 67, Schaubert et al teach microstrip patch radiator that is fabricated using standard printed circuit techniques to etch out a conductive strip on one side of a low-loss dielectric substrate with a conducting ground plane on the opposite side of the substrate. The conductive strip has thereon in a pre-determined geometric pattern at least two (or a greater plurality of) diodes which are connected between the conductive strip and the ground plane. The strip is excited at a selected feed point that is located along a diagonal of the rectangular strip. The polarization senses of the outwardly radiated energy are determined by shorting selected diodes to the ground plane, i.e. the application of a DC bias voltage to the diodes selectively completes an electrical path through the selected ones of the diodes between the conductive strip and the ground plane. FIG. 2 illustrates an embodiment of the microstrip antenna in accordance with Schaubert teaching that emits or receives radiation that is linearly polarized in either a vertical or horizontal direction, depending on which location diode or diodes are shorted to the ground plane while the other diodes provide open circuits. The Schaubert FIGS. 6A and 6B illustrate an embodiment of the microstrip antenna which may exhibit right or left circular polarization while Schaubert FIG. 7 illustrates an embodiment which may exhibit left or right circular polarization or either of the linear polarization senses.

Applicants' single channel transceiver with polarization diversity combines traditional single channel transceiver with the microstrip antenna as described above to provide a complete radar scattering matrix of a target. The following mathematical equations describe the complete matrix:

$$E_{rH}=a_{VH}E_{tV}+a_{HH}E_{tH} \quad (1)$$

$$E_{rV}=a_{VV}E_{tV}+a_{HV}E_{tH} \quad (2)$$

where, $E_{rH}$ and $E_{rV}$ are the total received voltages (energy scattered from the target) at horizontal polarization and vertical polarization, respectively; $E_{tH}$ and $E_{tV}$ denote horizontal outgoing pulse and vertical outgoing pulse, respectively; $a_{HH}$ denotes the target cross-section of the area to which a horizontal outgoing pulse was transmitted and from which horizontal scattered pulse was received; $a_{HV}$ signifies the target cross-section of the area to which a horizontal outgoing pulse was transmitted and from which vertical scattered pulse was received; $a_{VH}$ denotes the target cross-section of the area to which a vertical outgoing pulse was transmitted and from which horizontal scattered pulse was received and, finally, $a_{VV}$ denotes the target cross-section of the area to which a vertical outgoing pulse was transmitted and from which vertical scattered pulse was received.

Figure 3:
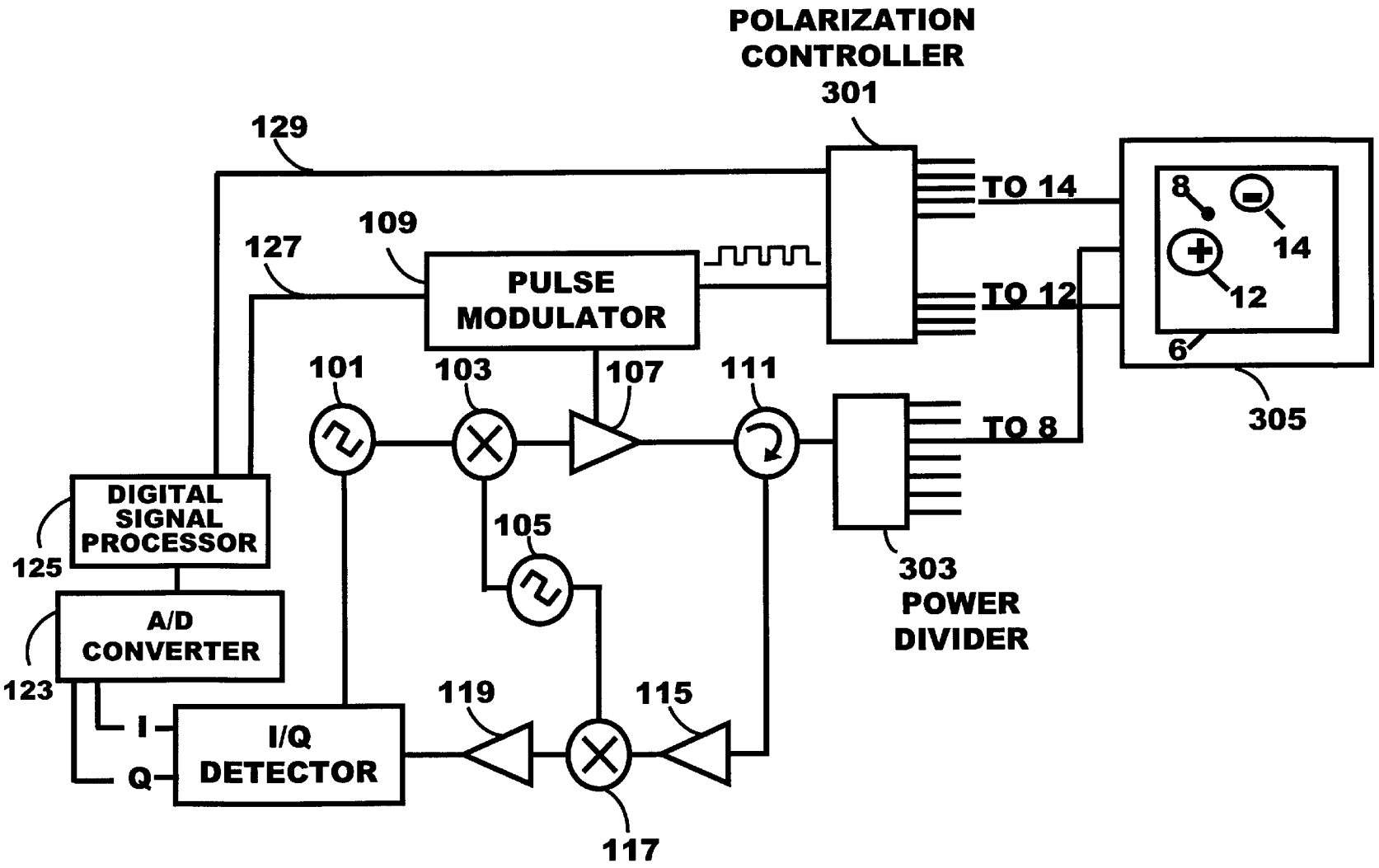
FIG. 3 depicts a preferred embodiment of the single channel transceiver with polarization diversity.

Applicants' FIG. 3 shows a preferred embodiment of the single channel transceiver with polarization diversity to obtain a complete radar scattering matrix of a radar target by receiving in rapid succession two scattered pulses of opposite polarizations. As illustrated in the figure, polarization controller 301 is coupled to receive pulse train emanating from pulse modulator 109 and process the pulses to derive therefrom signals that cause application of positive voltage to diode 12 located along the horizontal axis of symmetry of strip 6 and negative voltage to diode 14 located along the vertical axis of symmetry. This results in the emanation or reception of vertically polarized energy by antenna 305. Switching the application of the voltages, i.e. negative voltage to diode 12 and positive voltage to diode 14, changes the polarization of the energy to horizontal. (The label numbers of the diodes and the other components of the antenna are retained to be consistent with the Schaubert patent.) The number shown of microstrip antenna and the diodes is illustrative only; a plurality of diodes may be employed on each antenna in a given geometrical pattern in accordance with the teachings of Schaubert et al to achieve emission or reception of radiation of a pre-determined polarization sense, as well as a plurality of such antennas. If multiple antennas are to be utilized, in order to maintain the uniform polarization sense, each of the antennas must be identical to the other antennas in all aspects including connection of the diodes to polarization controller 301. Further, each antenna is connected to power divider 303 which, in turn, is connected to duplexer 111, the power divider dividing the total power in equal parts for each microstrip antenna element and coupling the power to all feedpoints 8. Second control line 129 from digital signal processor 125 to polarization controller 301 ensures that polarization switching is consistent with any changes in pulse repetition frequency and waveform that are sent to the pulse modulator via first control line 127 from the digital signal processor.

Figure 4:
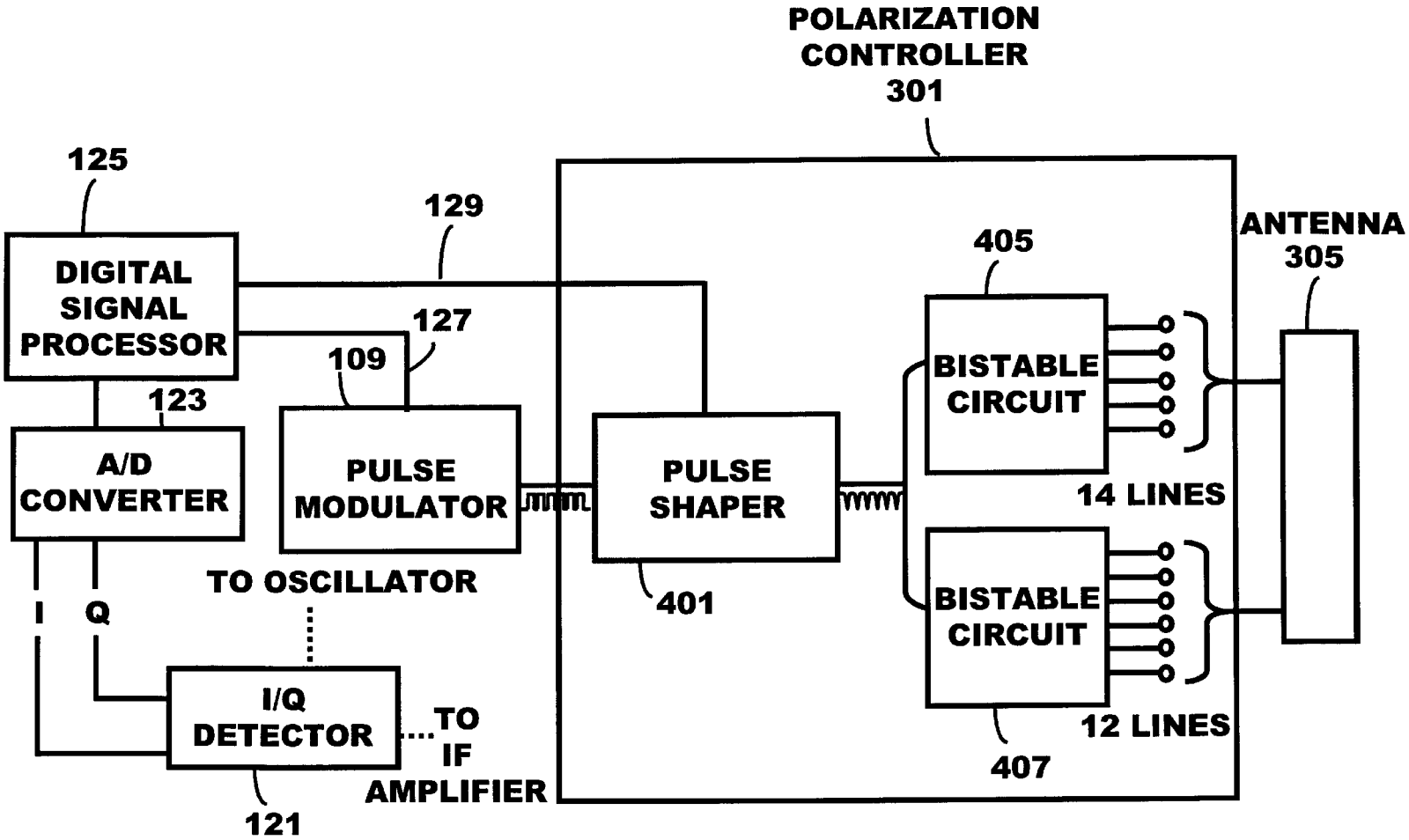
FIG. 4 shows the polarization controller in detail.

FIG. 4 shows the structure and operation of the polarization controller in greater detail. The pulse train emerging from pulse modulator 109 is fed to pulse shaper 401 that derives from the train a series of sharp trigger pulses capable of triggering the bistable circuits 405 and 407 and controls the precise time of arrival of the trigger pulses at the circuits for a pre-selected waveform and transmit-receive sequence. Bistable circuit 407 has therein an inverter circuit which causes it to emit a voltage of opposing polarity from that of voltage emitted by bistable circuit 405.

Figure 5:
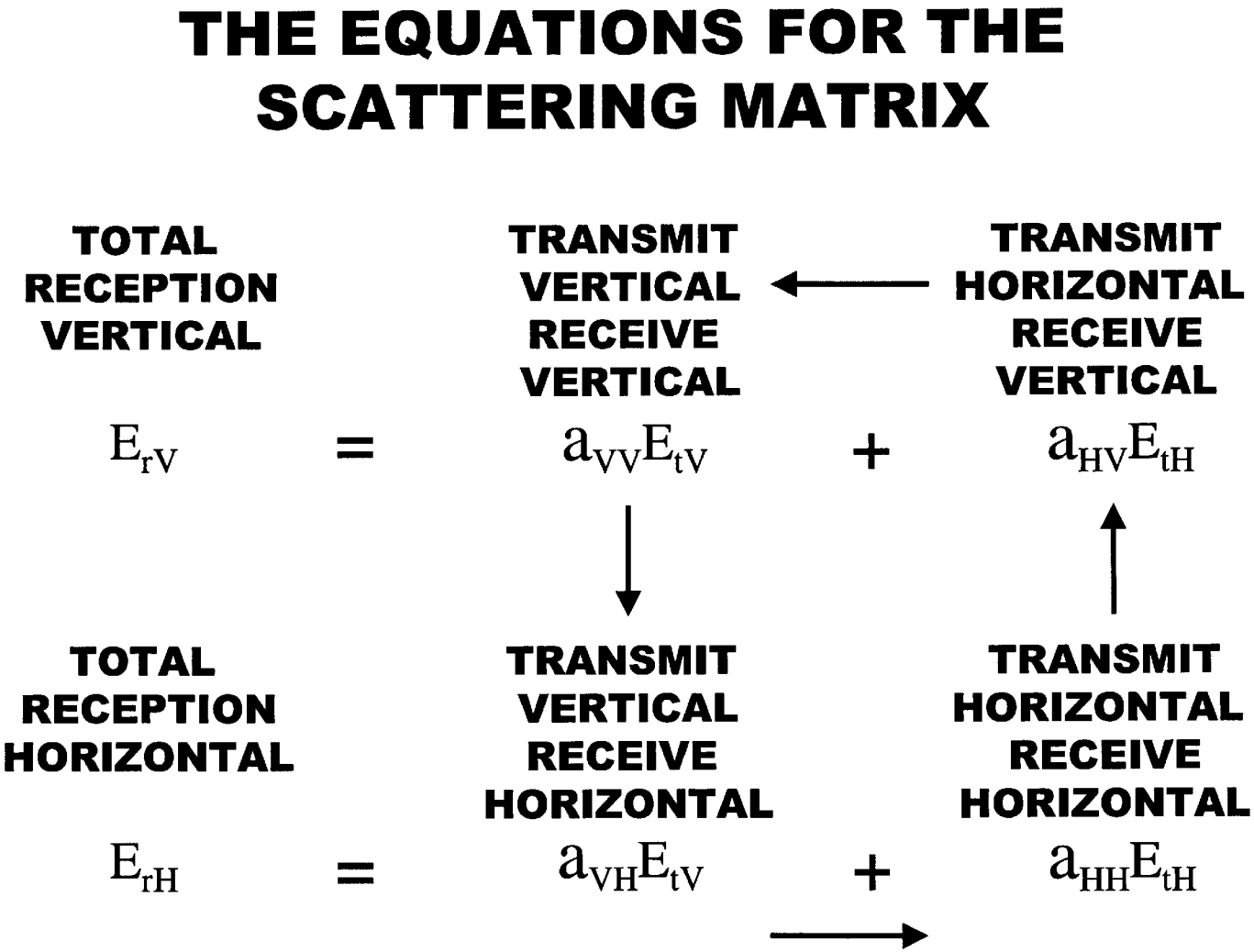
FIG. 5 summarizes a sequence of transmission of outgoing pulses and reception of scattered return pulses by the single channel transceiver with polarization diversity.

For an illustration of a specific waveform and transmit-receive sequence, assume that antenna 305 is initially in the vertical polarization state, shown in FIG. 4, with negative voltage applied to diodes 14 located along the vertical axis of symmetry of strip 6 of microstrip antenna 305 and positive voltage applied to diodes 12 located along the horizontal axis of symmetry. A sequence of two outgoing pulses (formed in the manner described above for traditional single channel transceiver) are transmitted from the antenna while in the vertical polarization state. The antenna is maintained in this state until the first scattered pulse is received from the target. The receipt and the processing of the first scattered pulse by the receiving components of the transceiver provides the necessary switching signal which travels from digital signal processor 125 via second control line 129 to pulse shaper 401. The pulse shaper, in response to the switching signal, sends a new trigger pulse to bistable circuits 405 and 407 to cause circuit 405 to apply a positive voltage to all diodes 14 and 407 to apply negative voltage to all diodes 12, thereby switching the antenna to the horizontal polarization state for the reception of the second scattered pulse. Upon the receipt of the second scattered pulse, the first terms on the left hand side of equations (1) and (2) are obtained. This is now followed by the transmission of the second sequential pair of outgoing pulses while the antenna is still in the horizontal polarization state. The antenna is maintained in this state until the reception of the first scattered pulse from the second sequential transmission. The reception and processing of the first scattered pulse from the second sequential again provides the necessary switching signal for the pulse shaper to send a trigger pulse to the bistable circuits which, in response, applies negative voltage to all diodes 14 and positive voltage to all diodes 12, once again setting the antenna in the vertical polarization state for the reception of the second scattered pulse from the second sequential transmission. With the completion of the second sequence, the second terms on the right hand side of equations (1) and (2) are obtained, thus providing the minimum number of measurements required to obtain an approximation to the full polarimetric scattering matrix. FIG. 5 summarizes the above-described transmit-receive operation, the arrows indicating the order of transmission and reception occurrence. If multiple antennas 305 are used, then in order to maintain polarization uniformity, all diodes 14, each located along the vertical axis of symmetry of strip 6 of each microstrip antenna, must be coupled to first bistable circuit 405 while all diodes 12, each located along the horizontal axis of symmetry of the strip of each antenna, must be coupled to second bistable circuit 407. The above-described pair of sequences may be repeated and also applied to other configurations of diodes that are taught by Schaubert.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. In a single channel transceiver having a pulse modulator for producing pulse trains, a signal processor for processing received scattered pulses and producing switching signals therefrom and a duplexer for maintaining separation between the transmitting and receiving functions of said transceiver; an improvement for imparting polarization diversity to said transceiver such that radiant energy of differing polarization senses may be transmitted from or received by said transceiver, said improvement comprising a microstrip antenna, said antenna having a conductive strip, a conducting ground plane and a dielectric substrate sandwiched between the strip and the plane, a power connector coupling the strip with the duplexer, said antenna further having a first diode and a second diode, the first diode being located in a pre-determined position with respect to the second diode and each diode providing a conductive path between the strip and the ground plane so as to result in transmission and reception of radiant energy of pre-determined polarization senses upon selective application of voltages to the diodes; and a means for selecting and controlling the application of voltages to the diodes, said selecting means being coupled simultaneously between the modulator, the signal processor and said microstrip antenna.

2. An improvement for imparting polarization diversity to a single channel transceiver as set forth in claim 1, wherein said selecting and controlling means comprises a polarization controller coupled between the pulse modulator, the signal processor and said microstrip antenna.

3. An improvement for imparting polarization diversity to a single channel transceiver as set forth in claim 2, wherein said polarization controller comprises a pulse shaper coupled to receive the pulse train from the pulse modulator and produce an output of trigger pulses, said pulse shaper being further coupled to the signal processor to receive the switching signals therefrom.

4. An improvement as set forth in claim 3, wherein said polarization controller further comprises a first bistable circuit and a second bistable circuit, both circuits being coupled to receive said trigger pulses from said pulse shaper and emit voltages simultaneously in response to said trigger pulses.

5. An improvement as set forth in claim 4, wherein said first bistable circuit is coupled to the first diode of said microstrip antenna and said second bistable circuit is coupled to the second diode of said microstrip antenna, said second bistable circuit further having therein an inverter circuit to cause said second bistable circuit to emit a voltage of opposing polarity from the polarity of voltage emitted by said first bistable circuit and said pulse shaper responds to said switching signals and causes said bistable circuits to alternate between applying a positive voltage and applying a negative voltage to their respectively-connected diodes such that said antenna achieves a given pattern of transmitting and receiving radiant energy of pre-determined polarizations.

6. In a single channel transceiver having a pulse modulator for producing pulse trains, a signal processor for processing received scattered pulses and producing switching signals therefrom and a duplexer for maintaining separation between the transmitting and receiving functions of said transceiver; an improvement for imparting polarization diversity to said transceiver such that radiant energy of differing polarization senses may be transmitted from or received by said transceiver, said improvement comprising a plurality of identical microstrip antennas, each of said antennas having a conductive strip, a conducting ground plane and a dielectric substrate sandwiched between the strip and the plane, a power connector suitable for coupling power to the strip, each of said antennas further having a first set of multiple diodes and a second set of multiple diodes, the first set and the second set of diodes being arranged in pre-determined locations with respect to each other and each diode of each set providing a conductive path between the strip and ground plane so as to result in the transmission from and reception by said antenna of radiant energy of pre-determined polarization senses upon selective application of voltages to the diodes; a means for selecting and controlling the application of voltages to the diodes, said selecting means being coupled simultaneously between the pulse modulator, the signal processor and said plurality of antennas and a power divider, said divider being coupled between the duplexer and the power connectors.

7. An improvement for imparting polarization diversity to a single channel transceiver as set forth in claim 6, wherein said selecting and controlling means comprises a polarization controller coupled between the pulse modulator, signal processor and to each of said microstrip antennas.

8. An improvement for imparting polarization diversity to a single channel transceiver as set forth in claim 7, wherein said polarization controller comprises a pulse shaper coupled to receive the pulse train from the pulse modulator and produce an output of trigger pulses, said pulse shaper being further coupled to the signal processor to receive the switching signals therefrom.

9. An improvement as set forth in claim 8, wherein said polarization controller further comprises a first bistable circuit and a second bistable circuit, both circuits being coupled to receive said trigger pulses from said pulse shaper and emit voltages simultaneously in response to said trigger pulses.

10. An improvement as set forth in claim 9, wherein said first bistable circuit is coupled in parallel to all of the first sets of diodes of said plurality of microstrip antennas and said second bistable circuit is coupled in parallel to all of the second sets of diodes of said plurality of microstrip antennas, said second bistable circuit further having therein an inverter circuit to cause said second bistable circuit to emit a voltage of opposing polarity from the polarity of voltage emitted by said first bistable circuit and wherein said pulse shaper responds to said switching signals and causes said bistable circuits to alternate between applying a positive voltage and applying a negative voltage to their respectively-connected sets of diodes such that said antennas achieve a given pattern of transmitting and receiving radiant energy of pre-determined polarizations.

* * * * *